US007431681B1

(12) United States Patent
St. Cyr

(10) Patent No.: US 7,431,681 B1
(45) Date of Patent: Oct. 7, 2008

(54) PLATFORM EXERCISE APPARATUS

(76) Inventor: William St. Cyr, 7134 Tranquility Dr., Demotte, IN (US) 46310

( * ) Notice: Subject to any disclaimer, the term of this patent is extended or adjusted under 35 U.S.C. 154(b) by 225 days.

(21) Appl. No.: 11/125,715

(22) Filed: May 10, 2005

(51) Int. Cl.
*A63B 21/00* (2006.01)

(52) U.S. Cl. ..... 482/121; 482/123; 482/129

(58) Field of Classification Search ..... 482/907, 482/121, 126, 146, 91, 123
See application file for complete search history.

(56) References Cited

U.S. PATENT DOCUMENTS

| | | | | |
|---|---|---|---|---|
| 118,740 | A | 9/1871 | O'Connor | |
| 1,019,861 | A | 3/1912 | Titus | |
| 1,623,670 | A | 4/1927 | Frankenfeld | |
| 1,691,092 | A | 11/1928 | Titus | |
| 3,633,907 | A * | 1/1972 | Cane et al. | 482/123 |
| 5,112,287 | A | 5/1992 | Brewer | |
| 5,269,737 | A | 12/1993 | Sobotka | |
| 5,352,176 | A | 10/1994 | Huang | |
| 5,391,134 | A | 2/1995 | Heatwole | |
| 5,529,562 | A * | 6/1996 | Glaser | 482/146 |
| 5,776,037 | A * | 7/1998 | Millington | 482/91 |
| 5,820,532 | A * | 10/1998 | Oliver | 482/123 |
| 6,220,994 | B1 * | 4/2001 | Rich | 482/123 |
| 6,245,001 | B1 | 6/2001 | Siaperas | |
| 6,872,175 | B2 * | 3/2005 | Lin | 482/146 |

* cited by examiner

*Primary Examiner*—Jerome Donnelly
(74) *Attorney, Agent, or Firm*—George Pappas

(57) ABSTRACT

A platform exercise apparatus includes a planar platform adapted for use on a floor and elevated therefrom with an elevating portion. A plurality of holes extend through the planar platform and define attachment bars therebetween. Elastic bands are provided having attachment hooks on one end thereof and a handle on the other end thereof. The elastic bands are selectively detachably attachable to the attachment bars with the hooks. The apparatus is used for exercise by standing thereon, grasping one or more of the handles and stretching the elastic bands. The apparatus is produced by injection molding the planar platform together with the elevating portion. Alternatively, the apparatus is made from a sheet of metal having the perimeter edges thereof bent to form the elevating portion, and by cutting or stamping the holes through the platform for thereby forming the attachment bars. An exercise bench can be used with the apparatus by positioning above the planar platform for thereby retaining the apparatus.

3 Claims, 5 Drawing Sheets

PLATFORM EXERCISE APPARATUS

BACKGROUND OF THE INVENTION

1. Field of the Invention

The present invention relates to exercise apparatus and, more particularly, to exercise apparatus including a platform and a plurality of elastic bands which are selectively attached to the platform for thereby exercising therewith.

2. Description of the Related Art

Various exercise devices are today available, known and/or used. Many of these exercise devices utilize elastic bands whereby the mechanical resistance offered by the stretching of the elastic bands provides the exercising resistance. Platform exercise devices are also known and have utilized elastic bands. Examples of platform exercise devices are disclosed in U.S. Pat. Nos. 1,019,861; 1,623,670; 1,691,092; 5,269,737; and, 6,220,994. Although these prior platform devices sufficiently function as a platform exercise device allowing the user to selectively stretch one or more elastic bands extending therefrom they, in general, are burdensome, awkward and potentially unstable to use, as well as difficult and/or would be costly to produce for mass markets.

Accordingly, a need exists for a platform exercise apparatus which not only is generally easily used by an individual exercising thereon and which can easily be stored when not in use, but which can generally easily be manufactured at a relatively lower cost.

SUMMARY OF THE INVENTION

The present invention overcomes the disadvantages of prior platform exercise devices by providing an exercise apparatus for use on a floor and which includes a planar platform elevated from the floor with an elevating portion attached to the platform. A plurality of holes extend through the platform and are aligned adjacent one another for thereby defining or forming attachment bars in the planar platform between the plurality of holes. Elastic bands or chords are provided and are detachably attachable to any one of the attachment bars. The elastic bands include, at one end thereof, a hook member which is selectively inserted through the platform holes and for attachment to an attachment bar. At the other end of each elastic band, a handle is provided for grasping by the individual and exercising by standing on the platform and selectively stretching the elastic bands away from the platform.

Preferably, each of the hook members include a safety spring member which, together with the hook, form a loop. Removal of the hook is, thus, prevented unless the safety spring member is depressed for forming an opening in the loop. The handles at the other end of the elastic bands are preferably either cross bars or annular shaped for easily grasping by the individual using the apparatus.

The exercise apparatus is preferably made of metal such as steel or aluminum. Most preferably, the planar platform is made of a sheet of metal wherein the perimeter edge thereof is bent for thereby forming the elevating portion. The plurality of holes extending through the metal sheet are cut or stamped therethrough so as to thereby form steel attachment bars therebetween.

Yet more preferably, in another embodiment, the planar platform and the elevating portion are integrally formed of plastic and are made by injection molding. The holes extending through the planar platform are, thus, formed during the injection molding process. So as to add additional strength to the attachment bar or portion between the holes, a metal pin may be imbedded, at least in part, within the plastic between the holes. The elevating portion in this embodiment includes a plurality of integrally formed plastic walls on one side of the planar platform.

Most preferably, the planar platform is generally square shaped having dimensions of about 26 inches by 26 inches, and the elevating portion maintains the planar platform about 2 inches above the floor.

In another embodiment, the exercise apparatus includes an exercise bench such as a weight lifting bench positioned above the planar platform. Accordingly, an individual exercising therewith may selectively lay horizontally on the exercise bench while stretching the elastic bands away from the planar platform therebelow. Preferably, the exercise bench includes a supporting base portion having a cross bar extending over the planar platform, and a pair of base legs extending from the cross bar to the floor, thus, straddling the exercise apparatus.

In one form thereof the present invention is directed to an exercise apparatus for use on a floor and includes a planar platform and an elevating portion attached to the platform whereby the platform is maintained above the floor. A plurality of holes extend through the platform and are adjacent one another thereby defining at least one attachment bar therebetween on the platform. An elastic band is detachably attachable to the attachment bar. The elastic band includes a handle whereby the exercise apparatus is used by selectively grasping the handle and stretching the elastic band away from the platform.

One of the primary objectives of the present invention is to overcome the disadvantages of prior platform exercise devices.

Another advantage of the present invention is that the planar platform provides superior balance and stability during use for providing a more effective workout routine.

One advantage of the present invention is that the top of the platform of the exercise device and the attachment bars associated therewith are essentially planar, thereby having no protruding elements that could create discomfort or potential injury to a user, or which otherwise limit the potential use of the platform in conjunction with other exercise equipment.

Another advantage of the present invention is that the attachment bars can be created during the molding of the platform or by a simple machining operation (e.g., stamping, drilling/boring to create holes in the platform).

Another advantage of the present invention is that the attachment bars can be readily reinforced at select locations of the platform, either before, during, or after hole formation, or by attaching a reinforcing strip of metal across the portion of the platform.

A yet other advantage of the present invention is that it can include an exercise bench that has a base specifically designed to straddle and thereby limit movement of the platform positioned below the bench.

An even further advantage of the present invention is that it can be used to perform a full range of strength-training exercises, especially when used in conjunction with an exercise bench.

BRIEF DESCRIPTION OF THE DRAWINGS

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF THE INVENTION

Figure 1:
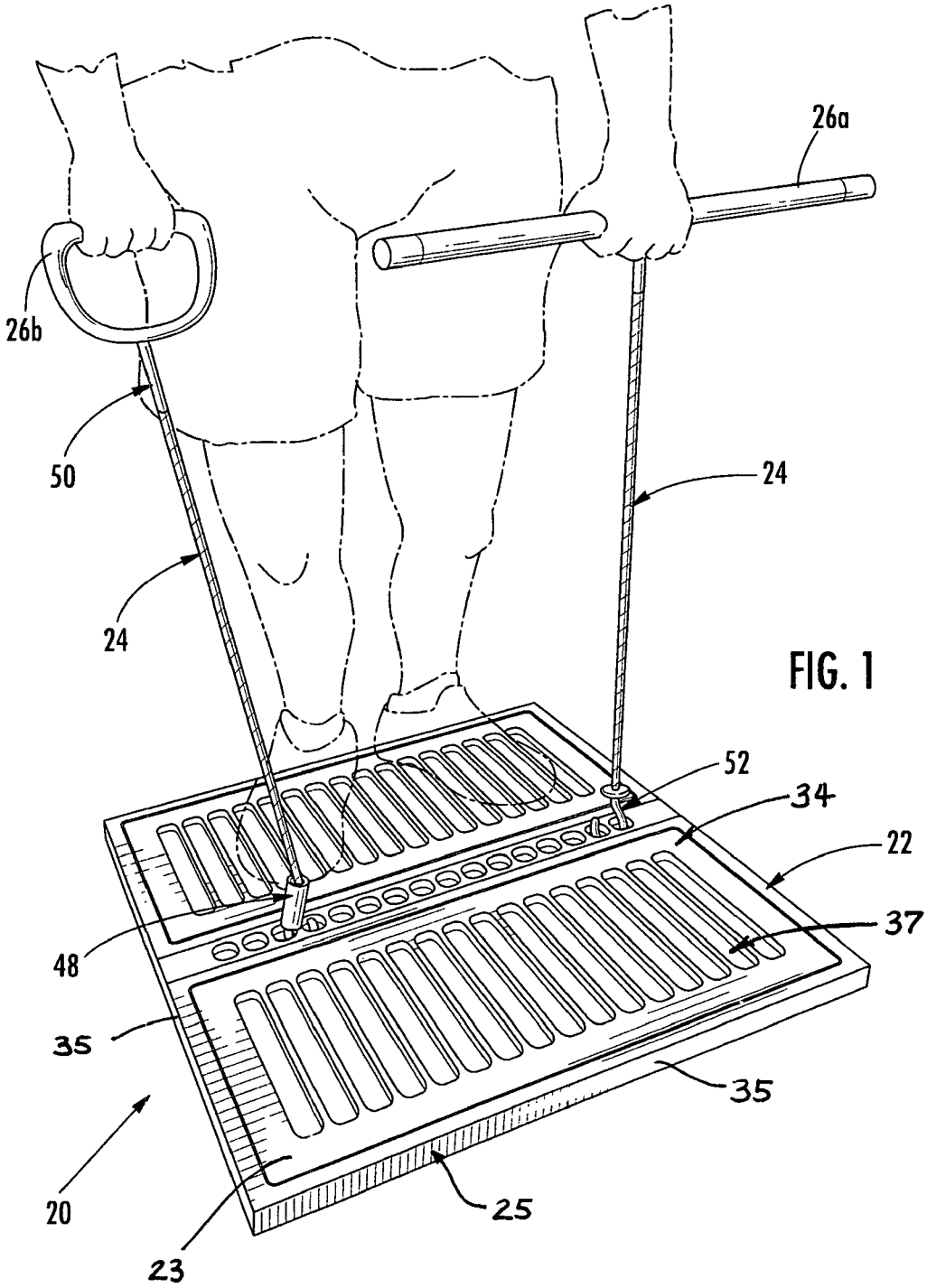
FIG. 1 is a perspective view of an embodiment of the platform exercise apparatus in accordance with the principles of the present invention and depicting the apparatus as would be used by an individual exercising thereon.

As illustrated in FIG. 1, a platform exercise apparatus or device 20 of the present invention includes a platform 22 and a plurality of elastic bands or cords 24.

Platform 22 includes a planar platform or flat sheet like portion 23 having a thickness 32 and an elevating portion 25 for elevating portion 23 above a floor 21. Platform 22 is preferably square shaped having a platform width 28, a platform depth 30, and a platform height 33. Advantageously, platform width 28 and platform depth 30 are each about 26 inches and the elevating portion 25 raises the top platform side 34 of portion 23 to an overall platform height 33 of about 2 inches. This platform shape has displayed good stability while not yet being overly cumbersome to move and store. A platform height 33 of two inches has been found useful in performing a variety of exercises. It is, however, to be understood that other dimensions of platform 22 could otherwise be chosen and still be within the scope of the present invention.

Figure 2:
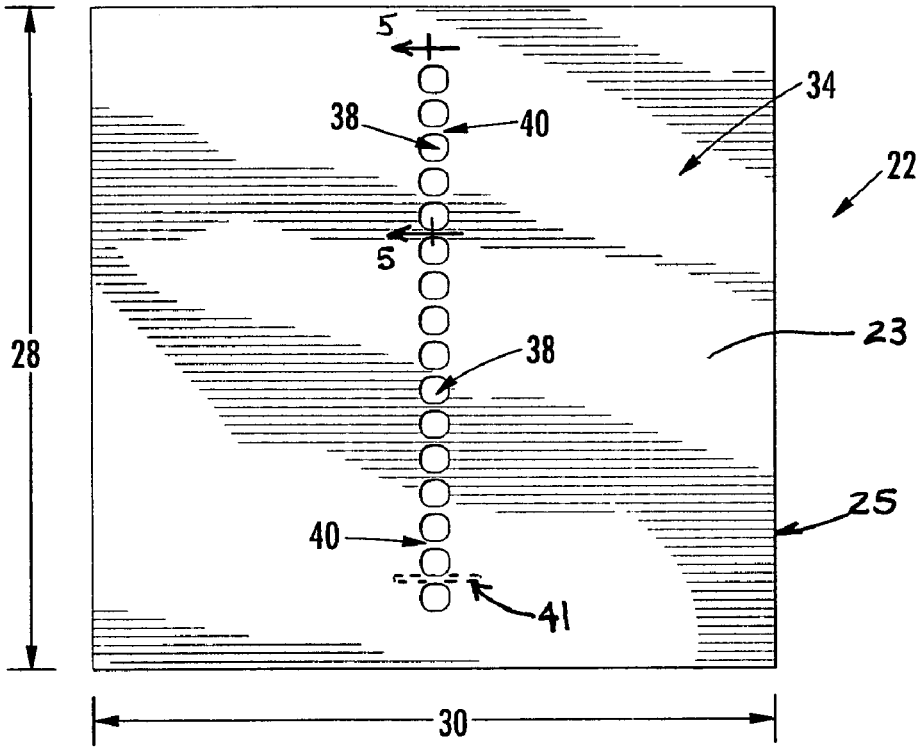
FIG. 2 is a top plan view of an embodiment of a platform exercise apparatus in accordance with the principles of the present invention.
Figure 3:
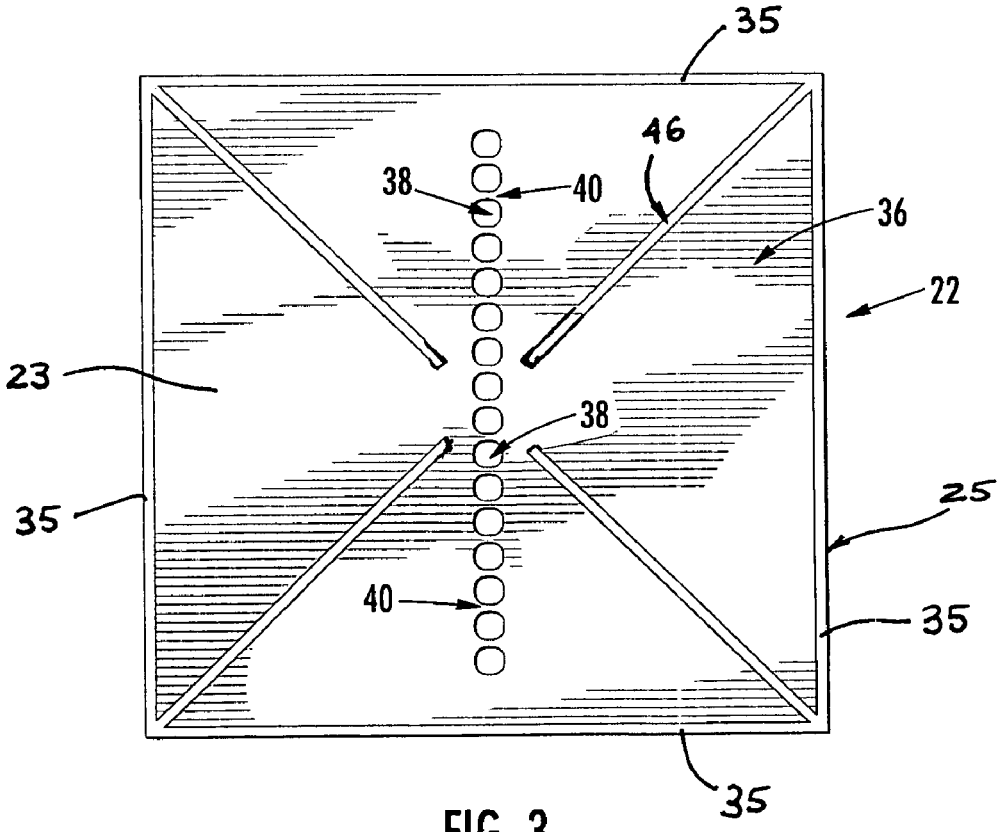
FIG. 3 is a bottom plan view of the platform exercise apparatus shown in FIG. 2.

As best seen in FIGS. 1-3, the planar platform portion 23 includes a top platform side 34 and a bottom platform side 36. A plurality of holes 38 are provided through the planar platform portion 23 in an array generally centrally located thereon as shown. Holes 38 are adjacent one another such that attachment bars 40 are thereby formed between and adjoining platform holes 38. In the embodiment of FIG. 1, a plurality of elongate slots 37 are provided and extend through the planar platform portion 23. Elongate slots 37 may be provided as shown for decreasing the material and weight of the planar platform portion 23.

The elevating portion 25, as shown in FIGS. 1-3, includes perimeter walls 35. Perimeter walls 35 are integrally formed with or otherwise attached to the perimeter of planar platform portion 23 and extend downwardly therefrom, as best seen in FIG. 1, thereby elevating the planar platform portion 23 above the floor 21. By raising the planar platform portion 23 and thus attachment bars 40 above the floor, the elastic bands 24 are selectively detachably attachable to attachment bars 40 as more fully described hereinbelow.

Platform 22 is preferably made of a metal sheet such as steel or aluminum, the perimeter edges of which are bent to form the perimeter walls 35 of the elevating portion 25. Holes 38 are cut through the metal sheet by machining or stamping. Alternatively, platform 22 can be made by an injection molding process whereby both the planar platform portion 23 and the elevating portion perimeter walls 35 are integrally formed using a single mold. By injection molding, interior support walls 46 can also be integrally formed on the bottom platform side 36 of the planar platform 23 for thereby increasing stability and decreasing the thickness 32 of portion 23. In an alternate embodiment, planar platform portion 23 is first cut to size and the holes 38 are formed therein and, thereafter, the perimeter walls 35 and/or interior support walls 46 are attached to the bottom platform side 36 of portion 23. It is noted that additional interior support walls 46 can be provided as needed for additional support and for decreasing the thickness 32 of the planar platform portion 23.

Figure 5:
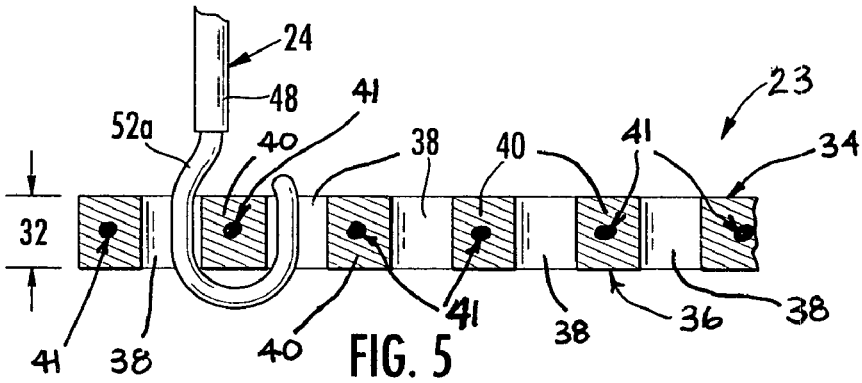
FIG. 5 is a partial cross sectional view of the planar platform portion shown in FIG. 2 taken along the section line 5-5.

In the cross section view of planar platform portion 23 shown in FIG. 5, adjacent holes 38 are shown extending through the planar platform portion 23 and thereby forming the attachment bars 40 therebetween. Accordingly, because portion 23 is elevated above the floor, a hook 52, such as a simple hook 52*a* attached to elastic band 24, can be detachably attached to the attachment bar 40 by inserting the hook 52 through holes 38. It is noted that attachment bars 40, as shown, have sufficient strength to withstand the forces placed thereon by the elastic bands 24. In the event attachment bars 40 require additional strength such as, for example, when the planar platform portion 23 is made of plastic, a metal pin 41 can be embedded within the plastic as shown in FIG. 5 and in dash lines in FIG. 2.

Figure 4:
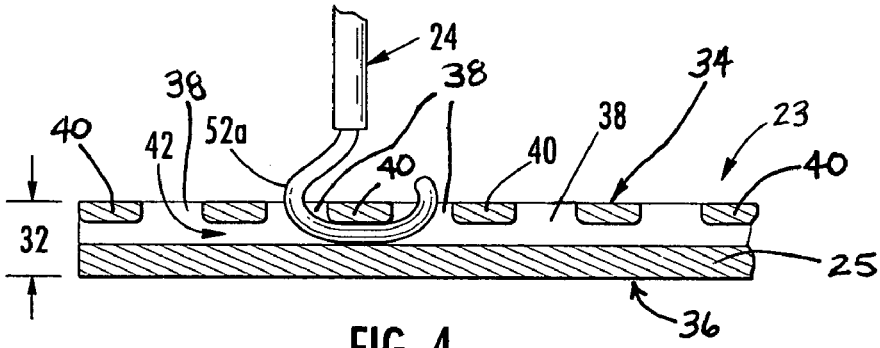
FIG. 4 is a partial cross sectional view similar to FIG. 5, but depicting an alternate embodiment.

In FIG. 4 which depicts a similar cross section to that of FIG. 5, but illustrates an alternate embodiment, the elevating portion 25 essentially extends across the entire bottom side of the planar platform portion 23 and also forms the bottom platform side 36. In this embodiment, the thickness 32 of the planar platform portion 23 includes the elevating portion 25 and, thus, the bottom platform side 36 rests on the floor 21. Additionally, the adjacent platform holes 38 are joined to one another below the top platform side 34 thereby forming a through-gap 42 under each of the attachment bars 40. Accordingly, hook 52*a* is detachably attached to the attachment bars 40 by inserting through the holes 38 and the through-gap 42 as shown.

Figure 6:
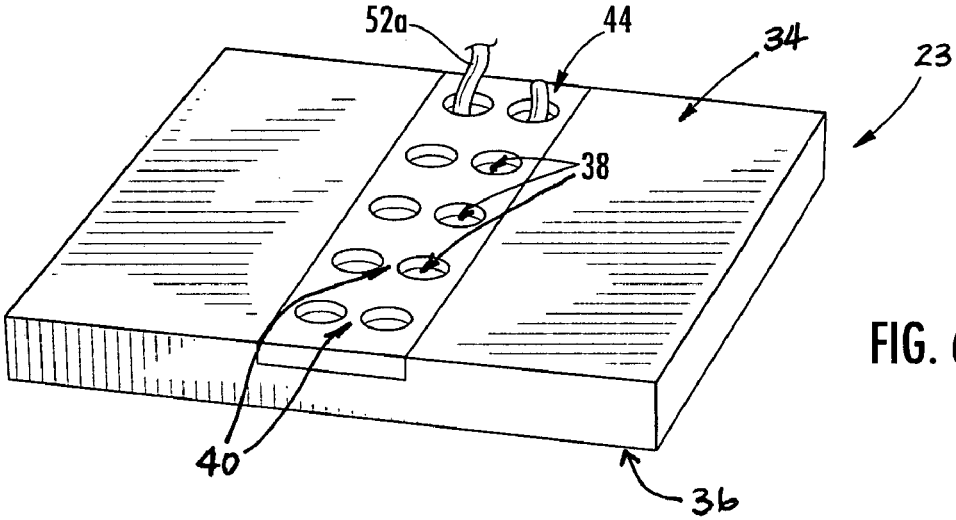
FIG. 6 is a partial view of a planar platform portion depicting another embodiment thereof constructed in accordance with the principles of the present invention.

In the embodiment shown in FIG. 6 the planar platform portion 23 is provided with a reinforcing inset 44 preferably made of metal and in which the platform holes 38 are formed. Reinforcing inset 44 is attached to or embedded in the planar portion 23.

As shown in FIG. 1, elastic bands or cords 24 (e.g., bungee cords) are used to provide the mechanical resistance as needed to achieve the desired exercise and workout with the exercise apparatus 20 of the present invention. As shown, an individual exercises with the apparatus 20 by placing the platform 22 on the floor, attaching one or more elastic bands 24 thereto and stretching/elongating the elastic bands as desired for exercising. It is noted that various types and strengths of bands 24 are available and can be used having varying elasticity for thereby providing more or less mechanical resistance as desired.

Figure 7:
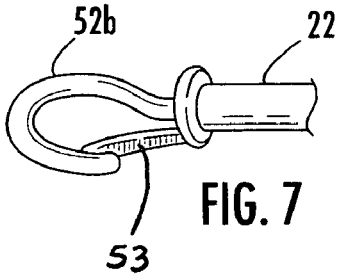
FIG. 7 is a side view of a safety hook latch mechanism for use on an elastic band in accordance with the principles of the present invention.

Each of the elastic bands 24 have a first band end 48 and a second band end 50. The hook mechanism 52 is attached to the first band end 38 and, as described hereinabove, permit the releasable attachment of the elastic band 24 to any one of the attachment bars 40 in the array of holes 38 of platform portion 23. Hook mechanism 52 can take the form of a simple hook 52*a* as described hereinabove or, preferably, can take the form of a latch safety hook 52*b* as shown in FIG. 7. In the preferred embodiment of FIG. 7, the hook 52*b* includes a safety spring member 53 thereby forming a loop as shown. As can be appreciated, the loop formed by safety spring member 53 prevents the removal of hook 52*b* from the attachment bars 40 unless the safety spring member 53 is depressed so as to form an opening in the loop.

A handle 26 is provided and attached to the second band end 50 of elastic bands 24. As shown in FIG. 1, handles 26 can take the form of an elongate bar 26*a* having a central portion whereat the elastic band 24 is attached. Handles 26 may also take the form of a thin grip or annular shape 26*b* whereat the elastic band 24 is attached. As shown, handles 26 are grasped by the individual standing on the planar platform 23 for thereby pulling on and selectively stretching the elastic band 24 as desired.

Figure 8:
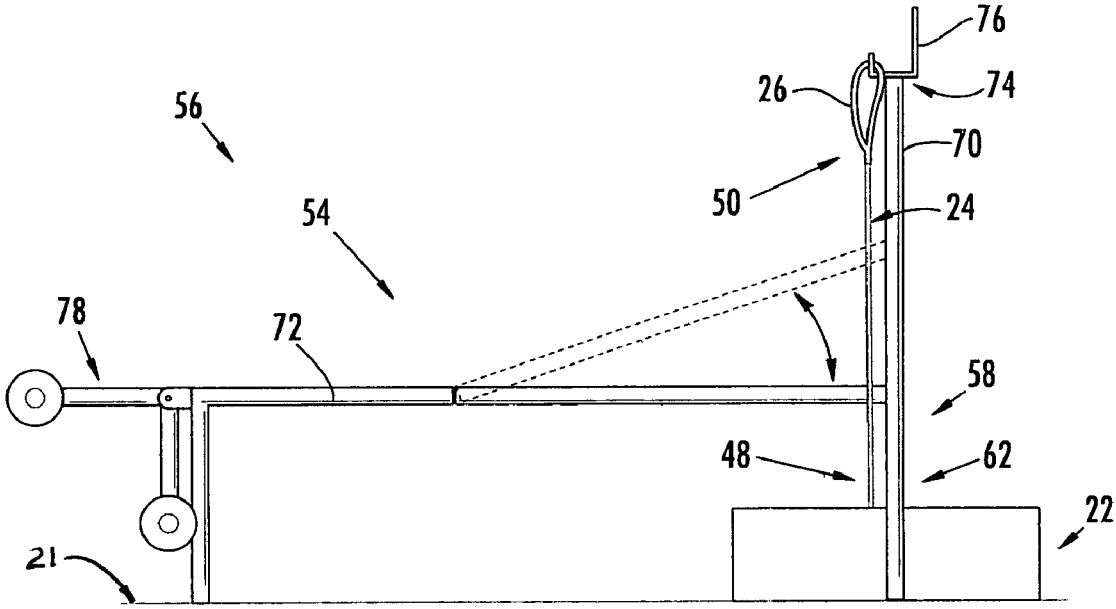
FIG. 8 is a side view of an exercise bench used in conjunction with the platform exercise apparatus in accordance with the principles of the present invention.
Figure 9:
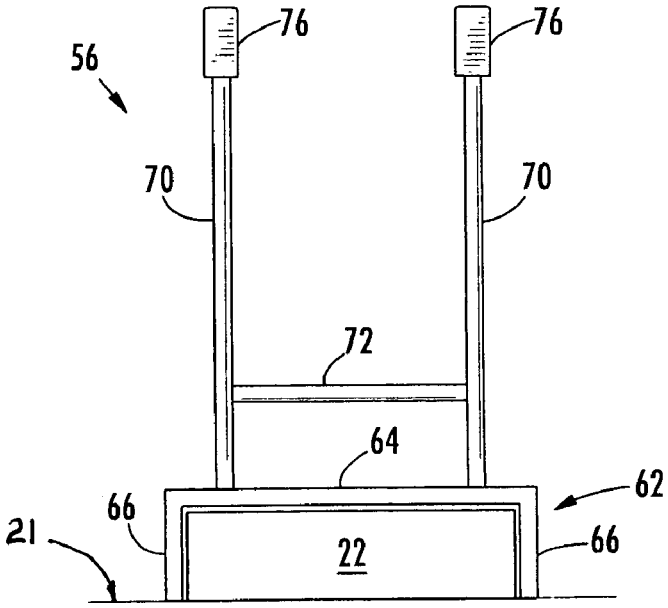
FIG. 9 is a front elevation view of the exercise bench and platform exercise apparatus shown in FIG. 8; and, FIG. 10 is an enlarged section of the front view of FIG. 9 showing the bench base straddling the platform exercise apparatus.
Figure 10:
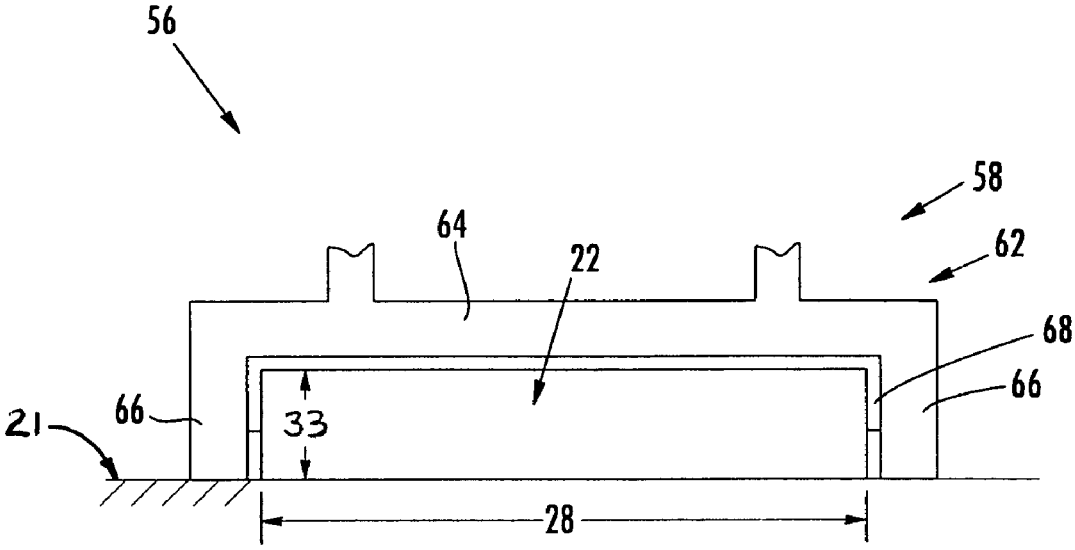

An exercise bench 54 (FIGS. 8 and 9) may be used in conjunction with exercise device 20 of the present invention to thereby create an exercise system 56. A standard exercise bench can be used but, advantageously, bench 54 includes modifications of the present invention that allow it to be best used with platform 22. Specifically, a bench frame 58 of bench 54 is modified to provide a bench base that includes at least one base portion 62 that is able to straddle platform 22 at the head of bench 54. By straddling platform 22, base portion 62 is able to hold and stabilize the position of platform 22 during a workout, as well as keep bench 54 level. Base portion 62 includes a base cross-bar 64 and two opposing base legs 66 extending therefrom to the floor 21. Advantageously, a thin gasket 68 is provided between base portion 62 and platform 22 to better hold platform 22 in place and to reduce potential wear between base portion 62 and platform 22.

Bench frame 58 is advantageously further provided with two extended support poles 70, in addition to a bench surface 72. Each extended pole 70 has a pole end 74 extending above a level of bench surface 72. Each pole end 74 carries a pole-end hook element 76 thereon. Pole-end hook element 76 is configured for receiving a handle 26 and/or an elastic band 24 thereon. Bench surface 72, as indicated in phantom, advantageously is pivotable near the middle thereof to allow the user to change the angle of their back for different exercises. Exercise bench 54 may further have a leg extension mechanism 78 pivotally mounted thereon to allow leg exercises to be performed.

While the invention has been described as having specific embodiments, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

I claim:

1. An exercise apparatus for use on a floor comprising:

a planar platform made of plastic;

a elevating portion attached to said platform whereby said platform is maintained above the floor;

a reinforcing inset made of metal attached to said planar platform and located centrally on said planar platform;

a plurality of holes extending through said reinforcing inset;

wherein said plurality of holes are located adjacent one another in an array located on said reinforcing inset and thereby define a plurality of attachment bars therebetween on said reinforcing inset, said attachment bars being located perpendicular to said array;

an elastic band detachably attachable to said attachment bars; and, said elastic band including a handle, whereby the exercise apparatus is used by selectively grasping said handle and stretching said elastic band away from said platform.

2. The exercise apparatus of claim 1, wherein said planar platform is generally square shaped having dimensions of at least about 26 inches by 26 inches and said elevating portion maintains said planar platform about 2 inches above the floor.

3. The exercise apparatus of claim 1, wherein said elevating portion includes a plurality of integrally formed plastic walls on a planar side of said planar platform.

* * * * *